United States Patent [19]

Schaeper et al.

[11] Patent Number: 4,579,314

[45] Date of Patent: Apr. 1, 1986

[54] ANNULAR BLOWOUT PREVENTER

[75] Inventors: Gary R. Schaeper; William M. Taylor; Bolie C. Williams, III, all of Houston, Tex.

[73] Assignee: Cameron Iron Works, Inc., Houston, Tex.

[21] Appl. No.: 696,086

[22] Filed: Jan. 29, 1985

Related U.S. Application Data

[63] Continuation-in-part of Ser. No. 484,512, Apr. 13, 1983, abandoned.

[51] Int. Cl.[4] ..... E21B 33/06

[52] U.S. Cl. ..... 251/1.2; 277/31

[58] Field of Search ..... 251/1 B, 1 R; 277/1.2, 277/30, 31, 32

[56] References Cited

U.S. PATENT DOCUMENTS

| | | | |
|---|---|---|---|
| 2,085,119 | 6/1937 | Penick et al. | 251/1 R |
| 2,926,031 | 2/1960 | Herr et al. | 277/32 |
| 3,268,233 | 8/1966 | Brown | 277/31 |
| 4,461,448 | 7/1984 | Huey et al. | 251/1 B |

*Primary Examiner*—Martin P. Schwadron
*Assistant Examiner*—Sheri M. Novack
*Attorney, Agent, or Firm*—Vinson & Elkins

[57] ABSTRACT

An annular blowout preventer having a body with a central bore therethrough and a packer recess surrounding and opening on said recess, an annular packer which is a complete ring or a split ring in said recess, means for actuating said packer to closed position, an opening through the side of said body into said packer recess of sufficient size to remove said packer therethrough, a plug sealed in said opening and a sleeve around said body to engage the exterior of said plug and retain it in sealing position in said opening.

10 Claims, 8 Drawing Figures

ANNULAR BLOWOUT PREVENTER

CROSS REFERENCE TO RELATED APPLICATIONS

This application is a continuation-in-part application of our prior co-pending application Ser. No. 484,512, filed Apr. 13, 1983, now abandoned.

BACKGROUND

In use the resilient packer of an annular blowout preventer can wear and be damaged. Changing the packer in present annular blowout preventers requires the removal of the upper end connection plus other elements of the BOP stack which are above the annular preventer such as the bell nipple, stripper, or rotating head. To do this clearance must be provided between the rig floor substructure and the top of he BOP to allow the top to be lifted clear to provide access to the packer. This is very inconvenient in snubbing operations. Also the top portion of most present annular blowout preventers is large and heavy which reduces the clearance and increases the difficulty of replacing the packer.

U.S. Pat. No. 2,154,955 discloses a well casing control valve having removable side plates allowing access for ram changes.

U.S. Pat. No. 2,320,974 discloses a ram type blowout preventer with removable side plates for changing internal ram operating mechanisms and rams.

U.S. Pat. No. 2,592,197 discloses a ram type blowout preventer with side windows for each ram for insertion and removal of the rams with covers secured over the windows for each ram for insertion and removal of the rams with covers secured over the windows.

None of the known prior art recognizes the problem of changing the annular packer in an annular blowout preventer. Flat door covering windows for access to rams in a ram type blowout preventer do not teach that the packer of an annular blowout preventer could be removed in a manner other than through the top.

SUMMARY

An improved annular blowout preventer having a body with a central bore therethrough, an annular packer recess surrounding and opening onto the bore, an annular packer positioned in said recess, means for axially loading the packer, at least one opening through the side of the body into the packer recess of sufficient size for the removal of the packer therethrough, a plug removably positioned in the opening to close the opening and form the exterior of said packer recess, a ring surrounding said body to retain said plug in position in said opening and means supporting said ring in position surrounding said body and retaining said plug in said opening.

An object of the present invention is to provide an improved annular blowout preventer in which the annular packer may be changed without regard to the vertical clearance available.

Another object is to provide an improved annular blowout preventer having simple and easy means for changing the annular packer.

A further object is to provide an improved annular blowout preventer with a side access to the annular packer without sacrificing the strength of the preventer body.

DESCRIPTION OF THE DRAWINGS

These and other objects and advantages of the present invention are hereinafter set forth and explained with respect to the drawings wherein.

DESCRIPTION OF THE PREFERRED EMBODIMENTS

Figure 1:
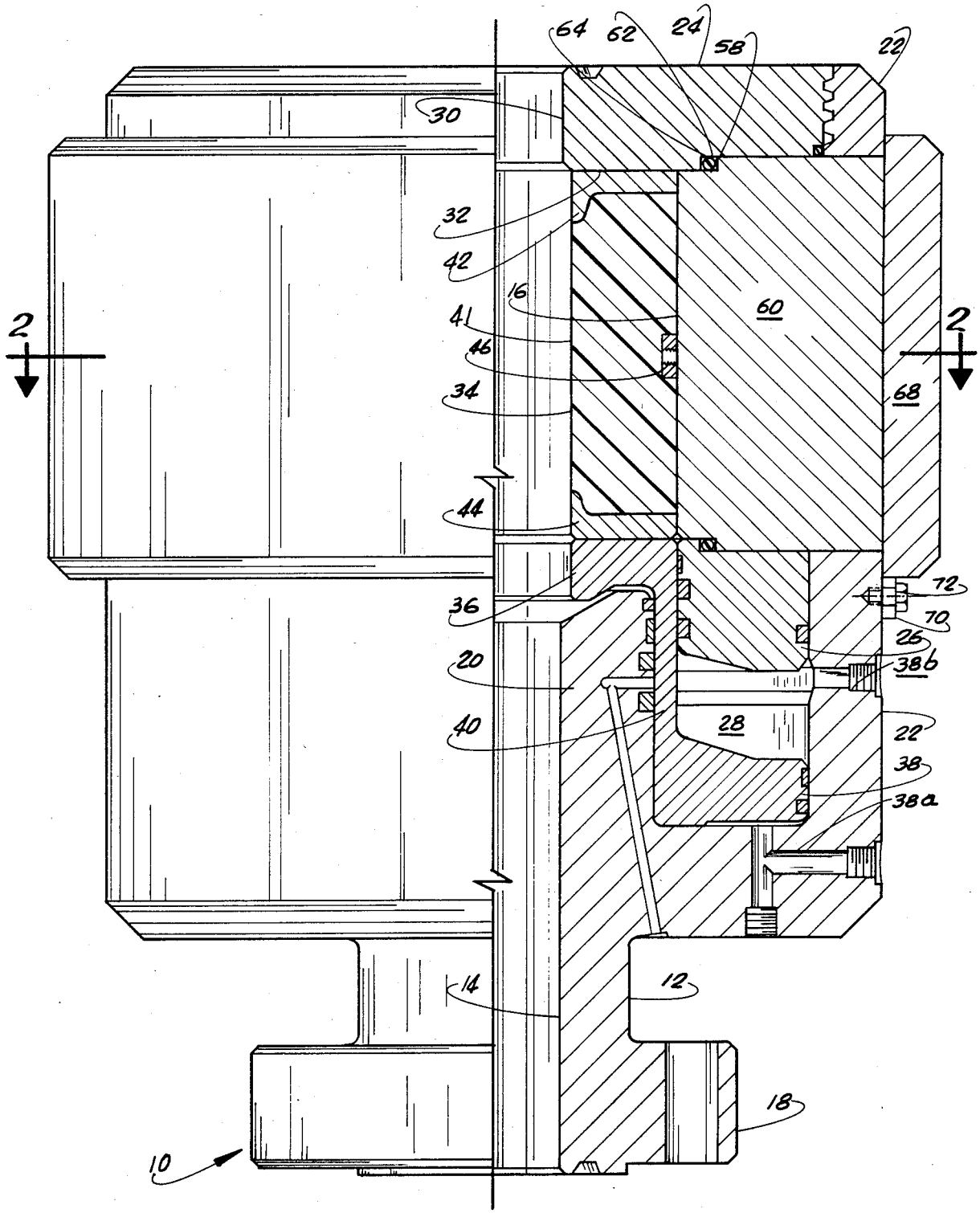
FIG. 1 is a partial sectional partial elevation view of the improved annular blowout preventer of the present invention.

Annular blowout preventer 10, as shown in FIG. 1, includes body 12 having central bore 14 extending therethrough with packer recess 16 surrounding and opening onto bore 14. Body 12 includes lower flange 18, inner upstanding rim 20 and outer upstanding rim 22. Upper end closure 24 is threaded into rim 22 and has depending rim 26 extending to a position between rims 20 and 22, and forming annular chamber 28. Upper end closure 24 extends inward as flange 30 to proved shoulder 32 at the upper end of packer recess 16. Annular packer 34 is positioned in packer recess 16 between shoulder 32 and annular actuating plate 36. Means for axially loading annular packer 34 is provided by piston 38 which is slidable in chamber 28 responsive to pressure through port **38*a* and port 38*b* and connected to annular actuating plate 36 by annular arm 40**.

Figure 2:
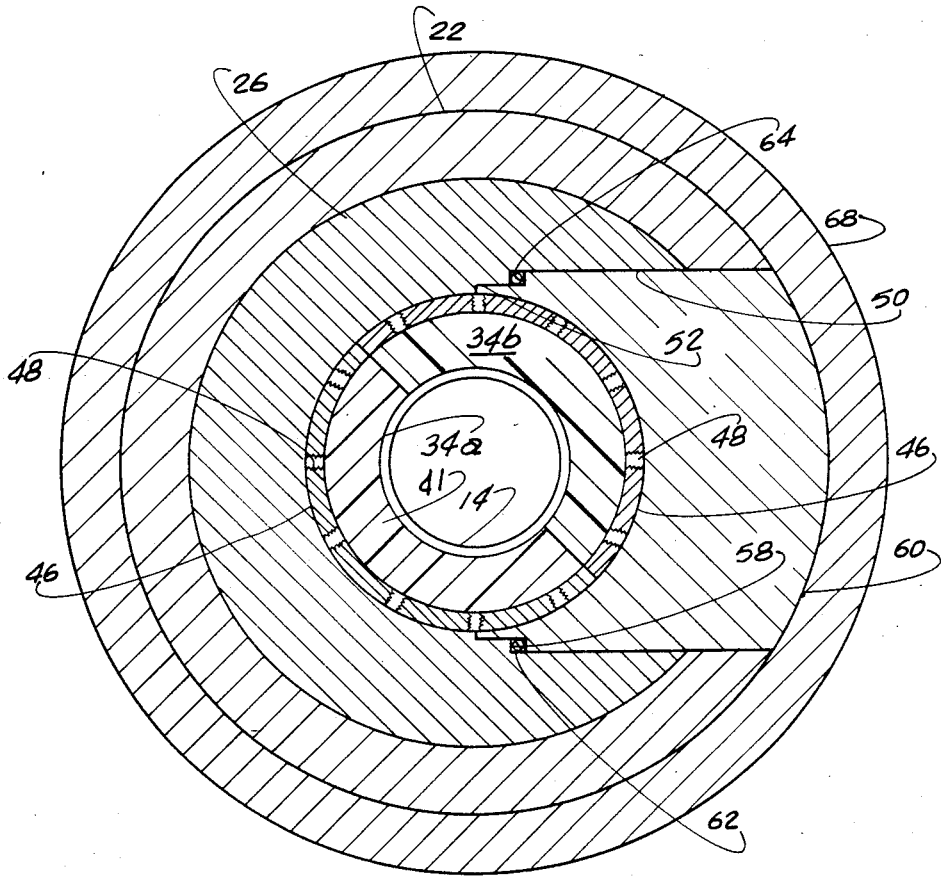
FIG. 2 is a sectional view through the packer taken along line 2—2 in FIG. 1.

Annular packer 34 includes resilient annulus 41 with upper insert plates 42 and lower insert plates 44 embedded therein. Annular packer 34 is split and preferably has two semi-annular sections **34*a* and 34*b*, as shown in FIG. 2. Ring 46, which included two sections (one of each of the packer sections), is embedded in the exterior of resilient annulus 41 and has a plurality of tapped holes 48 to allow firm engagement of packer 34 during removal. Annular packer 34 is split as described and shown to allow it to be removed easily from recess 16 through opening 50 in rim 22 and depending rim 26 of end closure 24 as best seen in FIG. 2**.

Opening 50 includes inner rectangular opening 52 with shoulder 54 at its inner end and outer rectangular opening 56 with shoulder 58 facing outward at the inner end of opening 56. Plug 60 is shaped to fit closely into opening 52 and 56, to engage shoulder 54 and capture seal ring 62 between shoulder 64 on plug 60 and shoulder 58. The inner surface 66 of plug 60 is cylindrical to form a portion of the wall of recess 16. Plug 60 is retained in opening 50 by sleeve 68 which surrounds outer rim 22 of body 12 from a position above opening 50 to a position below opening 50. Suitable means for supporting sleeve 68 in its plug retaining position is provided in the form of lugs 70 secured to outer rim 22 by screws 72.

Figure 3:
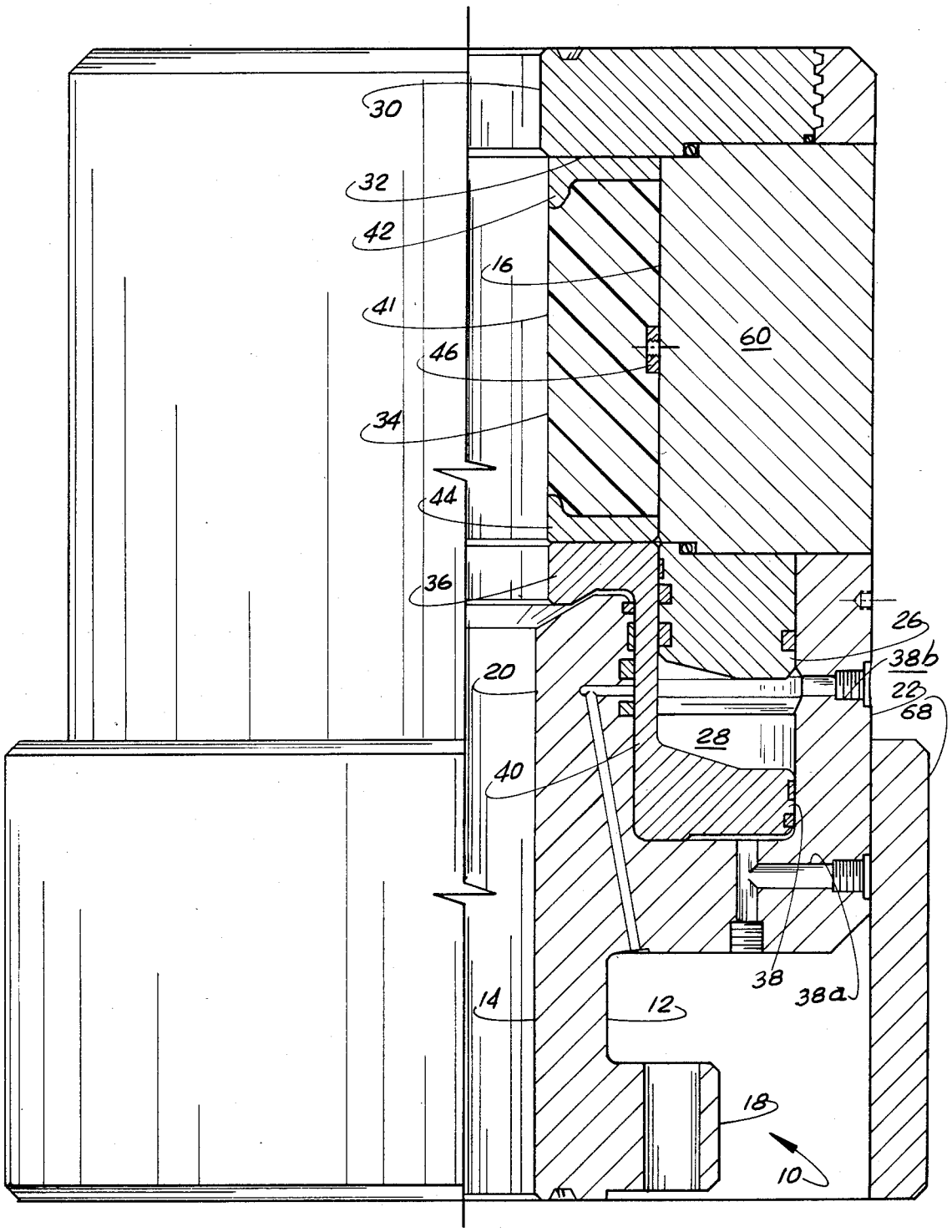
FIG. 3 is a view similar to FIG. 1 with the retaining sleeve lowered below the body plug.
Figure 4:
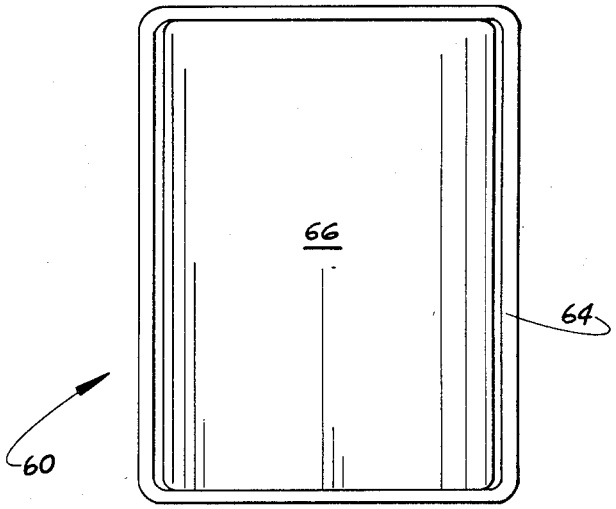
FIG. 4 is an end view of the plug.
Figure 5:
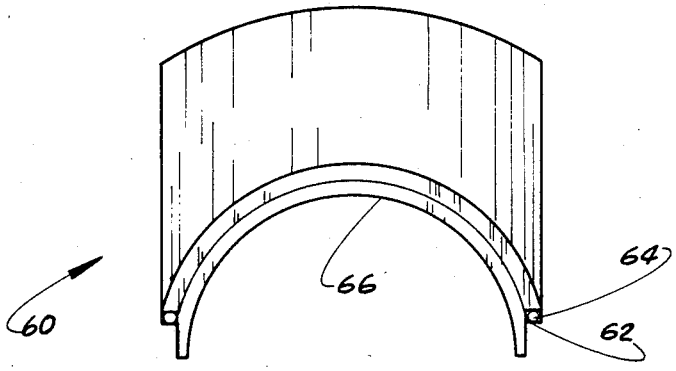
FIG. 5 is an interior plan view of the plug.

Whenever it is desired to replace packer 34 then screws 72 and lugs 70 are removed and sleeve 68 is lowered to the position shown in FIG. 3 so that plug 60 can be removed. With plug 60 removed packer sections 34*a* and 34*b* can be removed even with a pipe extending through bore 14.

Figure 6:
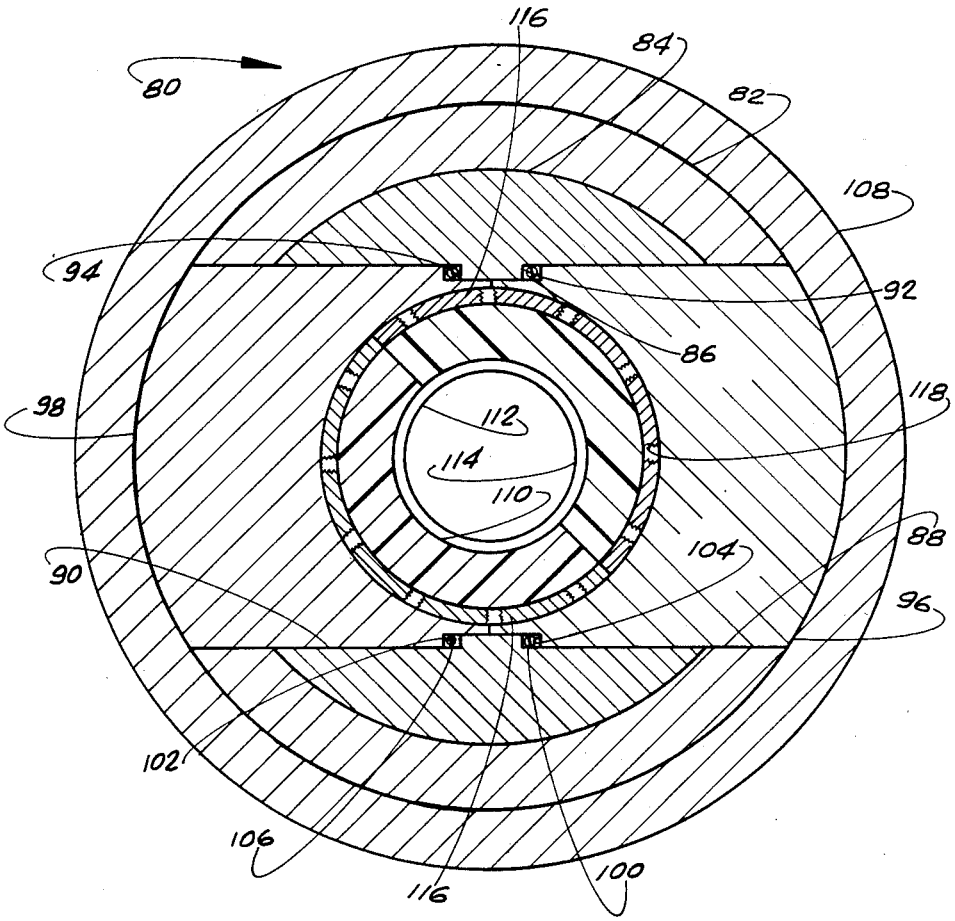
FIG. 6 is a sectional view similar to FIG. 2, but of a modified form of the present invention.

In the modified form shown in FIG. 6, annular blowout preventer 80 includes outer rim 82 and depending rim 84 of end closure with inner rectangular opening 86 extending transversely thereof and outer rectangular openings 88 and 90 provide shoulders 92 and 94. Plugs 96 and 98 are positioned therein and seal rings 100 and 102 are positioned between shoulders 104 and 106 on plugs 96 and 98 and shoulders 92 and 94. Sleeve 108 surrounds rim 82 and retains plugs 96 and 98 in position sealing both ends of opening 86. Packer 110 includes sections 112 and 114 and has split ring 116 embedded therein with tapped holes 118 to assist in removal of packer sections 112 and 114 through opposite sides of opening 86 after plugs 96 and 98 are removed.

Figure 7:
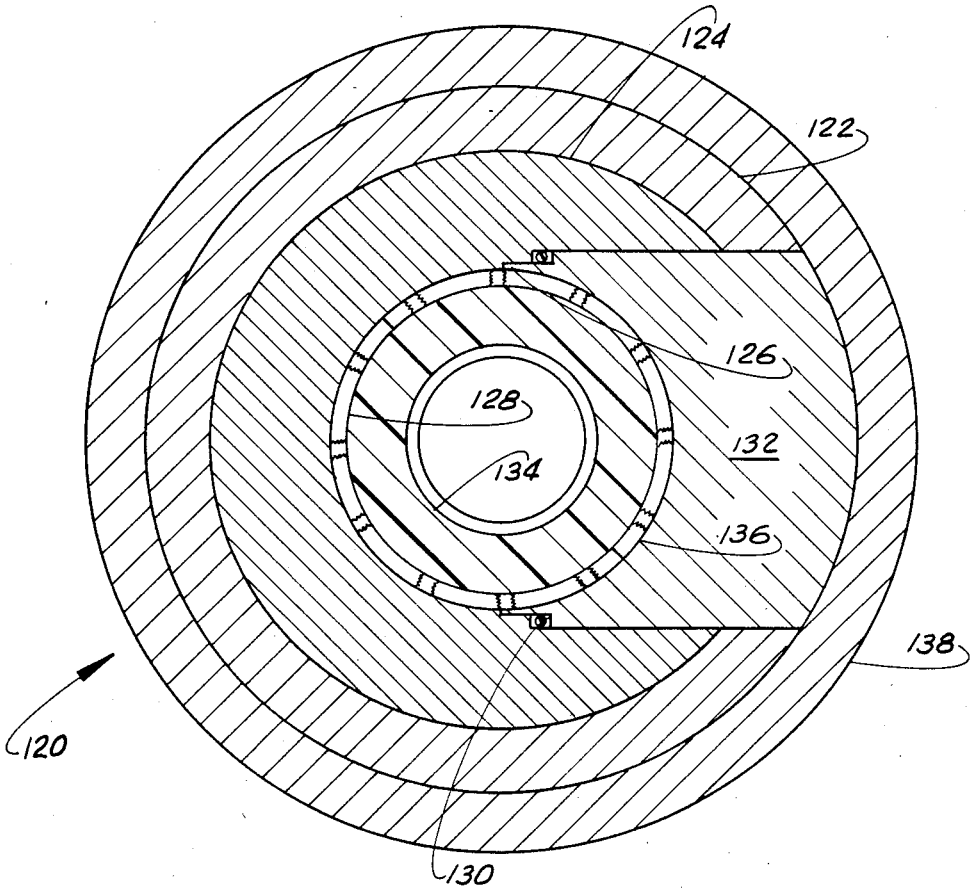
FIG. 7 is a sectioned view similar to FIG. 2 of another modified form of the present invention.

In the modified form of the invention shown in FIG. 7, annular blowout preventer 120 includes outer rim 122 and depending rim 124 of end closure (not shown) with inner rectangular opening 126 in depending rim 124 extending transversely outward from packer recess 128 within rim 124 on one side thereof. Shoulder 130 surrounds opening 126 and plug 132 is positioned and sealed within opening 126. Packer 134 is a complete annulus and includes ring 136 with tapped openings to assist in easy removal of packer 134 through opening 126. Packer 134 is similar to packer 34 except that it is a complete ring and thus, is not split into two pieces nor does it have a single split. Plug 132 is secured within opening by sleeve 138 which is similar to ring 68, previously described.

Figure 8:
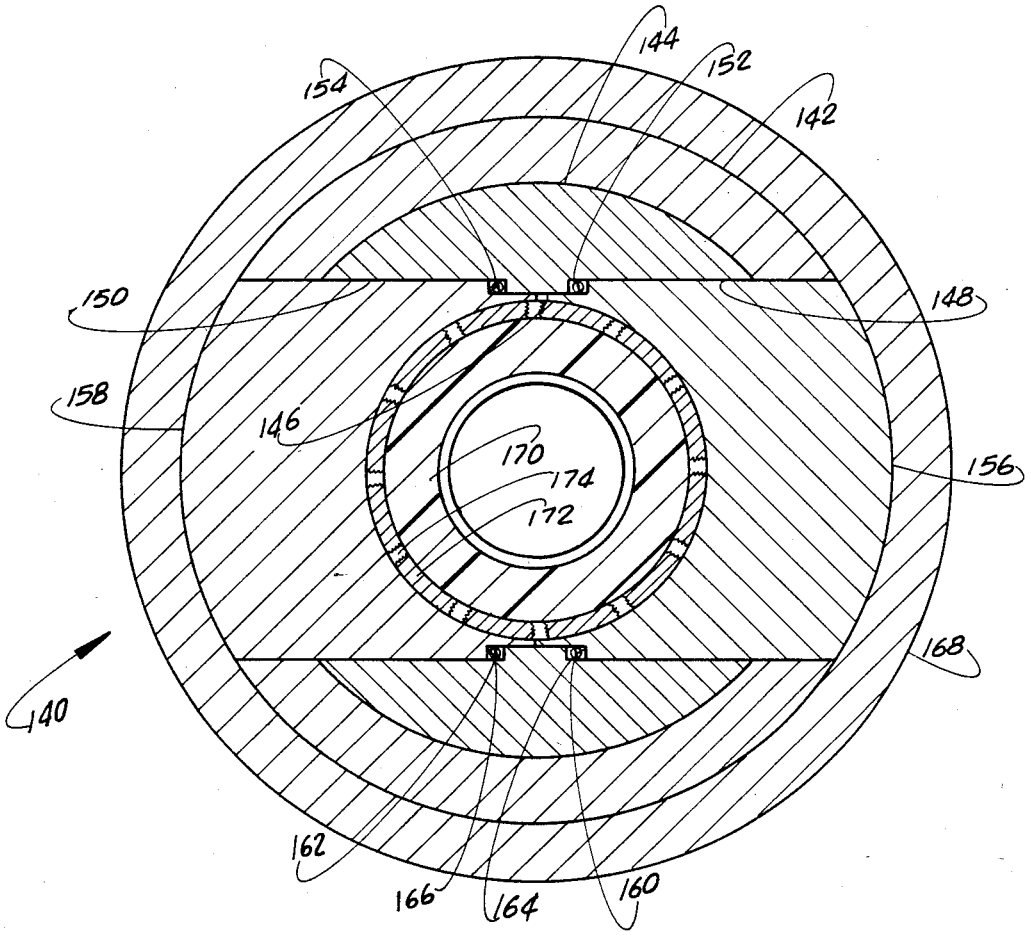
FIG. 8 is a sectional view similar to FIG. 2 of still another modified form of the present invention.

In still another form of the present invention shown in FIG. 8, annular blowout preventer 140 includes outer rim 142 and depending rim 144 of end closure (not shown) with inner rectangular opening 146 extending transversely thereof and outer rectangular openings 148 and 150 provide shoulders 152 and 154. Plugs 156 and 158 are positioned therein and seal rings 160 and 162 are positioned between shoulders 152 and 154 and shoulders 164 and 166 on plugs 156 and 158. Sleeve 168 surrounds rim 142 and retains plugs 156 and 158 in position sealing both ends of opening 146. Packer 170 has ring 172 embedded therein with tapped holes 174 to assist in removal of packer through opening 146 after either or both of plugs 156 and 158 are removed.

What is claimed is:

1. An annular blowout preventer comprising a body having a central bore extending therethrough with an annular packer recess surrounding and opening to said bore, an annular packer positioned in said recess in surrounding relationship to said bore, means for loading said packer to seal within said bore, an opening through the side of said body into said packer recess, a plug for sealing said opening and having an interior surface for supporting the exterior surface of said packer in said opening, and means for retaining said plug in said opening.

2. An annular blowout preventer according to claim 1 wherein said packer includes two sections.

3. An annular blowout preventer according to claim 1 including means in said packer allowing engagement therewith to pull said packer through said opening.

4. An annular blowout preventer according to claim 1 wherein said retainer includes a sleeve surrounding said body and engaging the exterior of said plug.

5. An annular blowout preventer according to claim 4 including means for retaining said sleeve in engagement with the exterior of said plug.

6. An annular blowout preventer according to claim 1 wherein said opening extends through both sides of said body with a plug in each side of said opening, and said packer is divided into two sections.

7. An annular blowout preventer comprising a body having a central bore therethrough and a recess surrounding and opening on said central bore, a split packer having a resilient annulus with a series of upper insert plates embedded in the upper surface of the annulus and a series of lower insert plates embedded in the lower surface of said annulus, said packer positioned in said recess, an annular piston chamber in said body with a piston movable therein responsive to pressure admitted to said chamber on opposite sides of said piston, said piston axially loading said packer, an opening through the side of said body into said packer recess, a plug removable positioned in said opening, and a sleeve surrounding said body and retaining said plug in position within said opening.

8. An annular blowout preventer comprising a body having a central bore extending therethrough with an annular packer recess surrounding and opening to said bore, an annular packer positioned in said recess, a ring embedded in the outer exterior of said packer and having threaded holes therein, an opening through the side of said body into said packer recess, said threaded holes allowing engagement of said packer to pull it through said opening, a plug for sealing said opening, and means for retaining said plug in said opening.

9. An annular blowout preventer comprising a body having a central bore extending therethrough with an annular packer recess surrounding and opening to said bore, an annular packer positioned in said recess and having two sections, means for loading said packer to seal within said bore including a piston movable vertically in said body, and an annular actuating plate engaging the underside of said packer, movement of said piston in one direction axially loading said packer to move inward into sealing position and in the other direction unloading said packer to allow it to relax from sealing position, an opening through the side of said body into said packer recess, a plug for sealing said opening, and means for retaining said plug in said opening.

10. An annular blowout preventer according to claim 1 wherein said packer includes a single annular ring.

* * * * *